United States Patent [19]

Fujii et al.

[11] Patent Number: 5,020,250

[45] Date of Patent: Jun. 4, 1991

[54] POWERED SNOWPLOW

[75] Inventors: Kiyoshi Fujii; Haruo Kitamura, both of Saitama; Shigeru Takahashi; Norio Shimizu, both of Iwate, all of Japan

[73] Assignee: Honda Giken Kogyo Kabushiki Kaisha, Tokyo, Japan

[21] Appl. No.: 586,257

[22] Filed: Sep. 21, 1990

[30] Foreign Application Priority Data

Sep. 21, 1989 [JP] Japan ..... 1-245653
Sep. 21, 1989 [JP] Japan ..... 1-245655

[51] Int. Cl.[5] ..... E01H 5/09
[52] U.S. Cl. ..... 37/257; 37/244
[58] Field of Search ..... 37/244, 247, 257, 259, 37/260

[56] References Cited

U.S. PATENT DOCUMENTS

| | | | |
|---|---|---|---|
| 2,919,504 | 1/1960 | Rubin | 37/244 |
| 3,115,714 | 12/1963 | Johann . | |
| 3,938,400 | 2/1976 | Konyha | 37/244 X |
| 4,062,135 | 12/1977 | Dobberpuhl . | |
| 4,514,917 | 5/1985 | Ogano et al. . | |
| 4,756,101 | 7/1988 | Friberg et al. | 37/244 |
| 4,783,915 | 11/1988 | Sasaki et al. . | |
| 4,836,320 | 6/1989 | Sundin | 37/244 X |
| 4,899,471 | 2/1990 | Sasaki et al. . | |

FOREIGN PATENT DOCUMENTS 63-110306 5/1988 Japan .

*Primary Examiner*—Dennis L. Taylor
*Assistant Examiner*—J. Russell McBee
*Attorney, Agent, or Firm*—Irving M. Weiner; Joseph P. Carrier; Pamela S. Burt

[57] ABSTRACT

A powered snowplow includes a snowplow body housing which houses at least a power source, a self-propelling mechanism supporting the snowplow body and drivable by the power source for propelling the snowplow, an auger mechanism mounted on a front portion of the snowplow body, the auger mechanism having a snow collecting auger, and a control mechanism mounted on a rear portion of the snowplow body. The control mechanism includes a first control lever operable for transmitting power from the power source to the self-propelling mechanism, a second control lever operable for transmitting power from the power source to the auger mechanism, an auger height adjusting handle disposed near the second control lever, for adjusting a height of the auger, and an interlink plate for keeping the second control lever operated in coaction with the first control lever when the first control lever is operated.

12 Claims, 4 Drawing Sheets

POWERED SNOWPLOW

BACKGROUND OF THE INVENTION

1. Field of the Invention

The present invention relates to a powered snowplow having a snow collecting auger and a snow blower, and more particularly to such a self-propelled snowplow which includes a wheel clutch lever and an auger clutch lever that are interlinked with each other and which also has an auger height adjusting handle for manually adjusting the height of the auger.

2. Description of the Prior Art

Some powered snowplows have a snow collecting auger disposed in front of a snowplow body and rotatable by an engine in the snowplow body for collecting snow. The collected snow is discharged through a shooter by a snow blower which is positioned behind the snow collecting auger.

The snow collecting auger is sometimes adjusted in height depending on the qualities of the snow and the surface conditions on which the snowplow is used. The height of the snow collecting auger is generally adjusted manually or hydraulically. A snowplow disclosed in Japanese Laid-Open Patent Publication No. 63(1988)-110306, for example, makes auger height adjustments with both a manual control lever and a foot pedal Operation of the disclosed snowplow has to be interrupted while the height of the auger is being adjusted.

SUMMARY OF THE INVENTION

In view of the above drawbacks of the conventional powered snowplows with auger height adjustment, it is an object of the present invention to provide a powered snowplow which allows auger height adjustments to be manually effected easily when the snowplow is clearing away snow while moving, so that the auger height can be optimized with respect to the load on the snowplow depending on the qualities of the snow which is being handled by the snowplow and other conditions, whereby the snow can be cleared away with high efficiency.

According to the present invention, there is provided a powered snowplow comprising a snowplow body which houses at least a power source, a self-propelling mechanism supporting the snowplow body and drivable by the power source for propelling the snowplow, an auger mechanism mounted on a front portion of the snowplow body, the auger mechanism having a snow collecting auger, and a control mechanism mounted on a rear portion of the snowplow body. The control mechanism includes a first control lever operable for transmitting power from the power source to the self-propelling mechanism, a second control lever operable for transmitting power from the power source to the auger mechanism, an auger height adjusting handle disposed near the second control lever, for adjusting a height of the auger, and means for keeping the second control lever operated in coaction with the first control lever which is operated.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
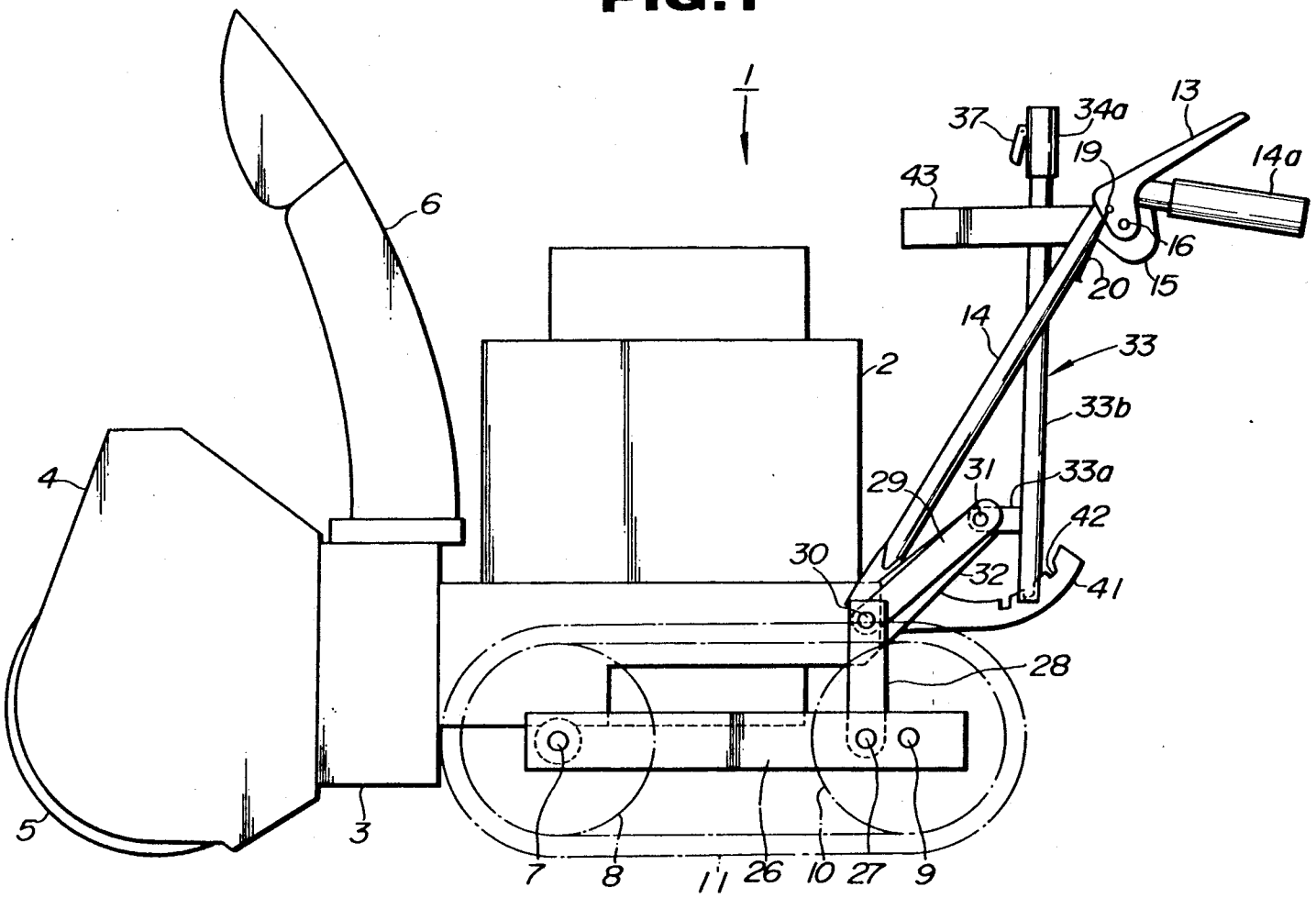
FIG. 1 is a schematic side elevational view of a powered snowplow according to a preferred embodiment of the present invention.

As shown in FIG. 1, a powered or self-propelled snowplow 1 includes a snowplow body 2 which houses an engine and a transmission that are fixedly mounted on a snowplow frame, a blower housing 3 disposed in front of the snowplow body 2, and an auger housing 4 disposed in front of the blower housing 3. The auger housing 4 houses an auger 5 which is rotated by the engine in the snowplow body 2 to collect snow. The collected snow is discharged from a shooter 6 mounted on the blower housing 3 by a blower (not shown) disposed in the blower housing 3, thereby clearing away snow in front of the snowplow 1.

The snowplow 1 has a self-propelling mechanism which comprises a drive axle 7 extending transversely below and supported by a front portion of the snowplow body 2, a pair of front drive wheels 8 mounted on the respective opposite ends of the drive axle 7, a driven axle 9 extending transversely below and supported by a rear portion of the snowplow body 2, a pair of rear driven wheels 10 mounted on the respective opposite ends of the driven axle 9, and a pair of crawlers 11 trained around the respective lateral pairs of drive and driven wheels 8, 10. The power of the engine in the snowplow body 2 is transmitted through the transmission to the drive axle 7, thereby rotating the drive wheels 8, so that the snowplow 1 is driven by the crawlers 11.

Figure 3:
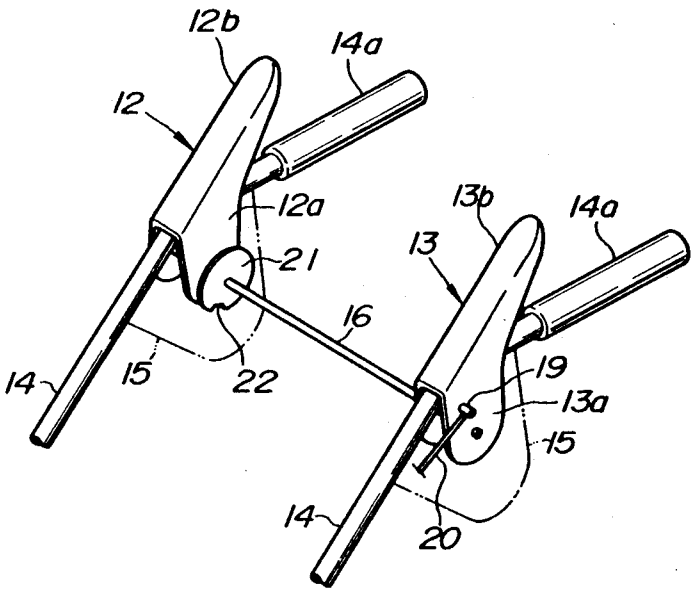
FIG. 3 is a fragmentary perspective view of the rear portion shown in FIG. 2.
Figure 2:
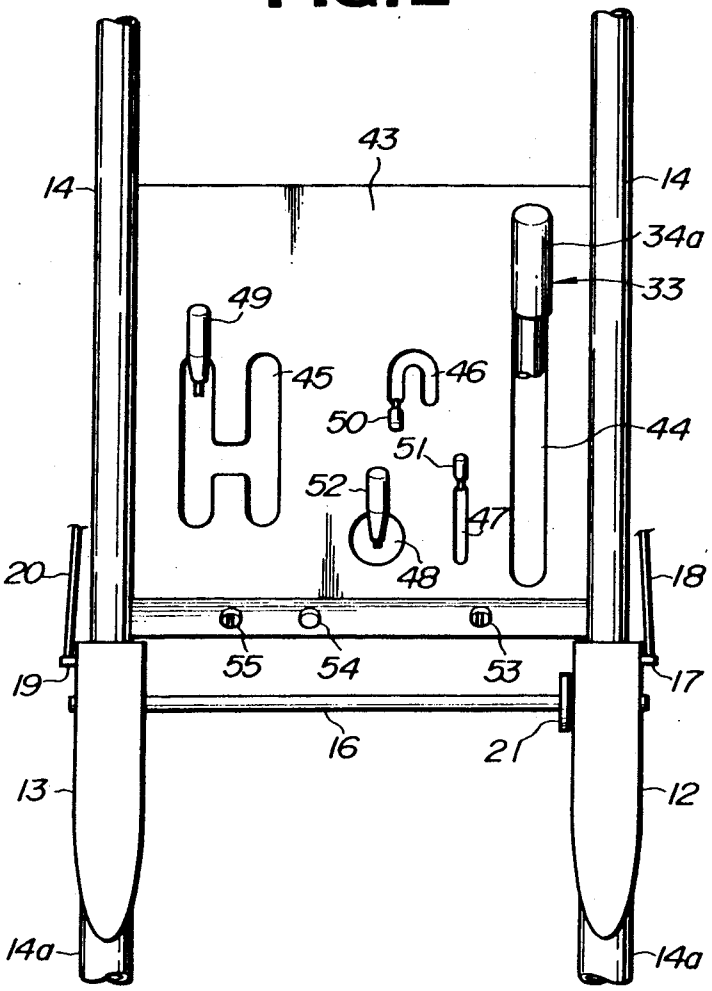
FIG. 2 is a plan view of a rear portion of the powered snowplow shown in FIG. 1.

A pair of laterally spaced handle pipes or handlebars 14 extends rearwardly and upwardly from the rear portion of the snowplow body 2. The handle pipes 14 serve as a handle for maneuvering the snowplow 1. As shown in FIGS. 1 through 3, an auger clutch lever 12 and a wheel clutch lever 13, which actuate respective clutches (not shown) for selectively transmitting the engine power to the auger 5 and the drive axle 7, respectively, are pivotally connected to the handle pipes 14 near grips **14*a*** on upper rear ends thereof.

When the levers 12, 13 are gripped, the corresponding clutches are engaged to transmit the engine power.

When the levers 12, 13 are released, the corresponding clutches are disengaged to cut off the engine power. The auger clutch lever 12 and the wheel clutch lever 13 are interlinked such that when the wheel clutch lever 13 is gripped and the auger clutch lever 12 is further gripped, the auger clutch lever 12 is locked in the gripped condition.

The auger clutch lever 12 and the wheel clutch lever 13 will now be described in detail.

In FIGS. 1 through 3, the upper rear ends of the handle pipes 14 are bent rearwardly substantially horizontally, and the grips 14*a* are mounted on the bent upper rear ends of the handle pipes 14. Downwardly extending brackets 15 are fixed to the respective handle pipes 14 in front of the grips 14*a*. A support shaft 16 is rotatably supported on and extends between the brackets 15. In the illustrated embodiment, the auger clutch lever 12 is attached to the righthand handle pipe 14 as viewed from behind the snowplow 1. The auger clutch lever 12 comprises an attachment base 12*a* having an inverted U-shaped cross section and disposed downwardly astride the handle pipe 14, and an arm 12*b* extending from the attachment base 12*a* upwardly of the grip 14*a*. The attachment base 12*a* is angularly movably mounted on the support shaft 16 which extends loosely through the attachment base 12*a*. The wheel clutch lever 13 is attached to the lefthand handle pipe 14 as viewed from behind the snowplow 1. The wheel clutch lever 13 also comprises an inverted U-shaped attachment base 13*a* and an arm 13*b* extending therefrom. The attachment base 13*a* is angularly movably mounted on the support shaft 16 which extends through and is fixed to the attachment base 13*a*. Therefore, the levers 12, 13 are angularly movable around the support shaft 16 such that the wheel clutch lever 13 swings conjointly with the support shaft 16, whereas the auger clutch lever 12 swings independently around the support shaft 16.

A pin 17 is mounted on an outer side of the attachment base 12*a* of the auger clutch lever 12, and is operatively connected by a cable 18 to the clutch which selectively transmits the engine power to the auger 5. Similarly, a pin 19 is mounted on an outer side of the attachment base 13*a* of the wheel clutch lever 13, and is operatively connected by a cable 20 to the clutch which selectively transmits the engine power to the drive axle 7. When these clutches are disengaged, the arms 12*b*, 13*b* of the clutch levers 12, 13 are spaced upwardly from the respective grips 14*a* under the tensile resiliency of the cables 18, 20.

When the arms 12*b*, 13*b* and the corresponding grips 14*a* are gripped together, the cables 18, 20 are pulled rearwardly, i.e., upwardly in FIG. 1, the clutches associated with the auger 5 and the drive axle 7 are individually engaged, thereby transmitting the engine power to the auger 5 and the drive axle 7. When the arms 12*b*, 13*b* are released from the gripping force, the cables 18, 20 are pulled forwardly, i.e., downwardly in FIG. 1, under their own tensile resiliency, the clutches associated with the auger 5 and the drive axle 7 are independently disengaged, so that the engine power transmitted to the auger 5 and the drive axle 7 is cut off.

Figure 4:
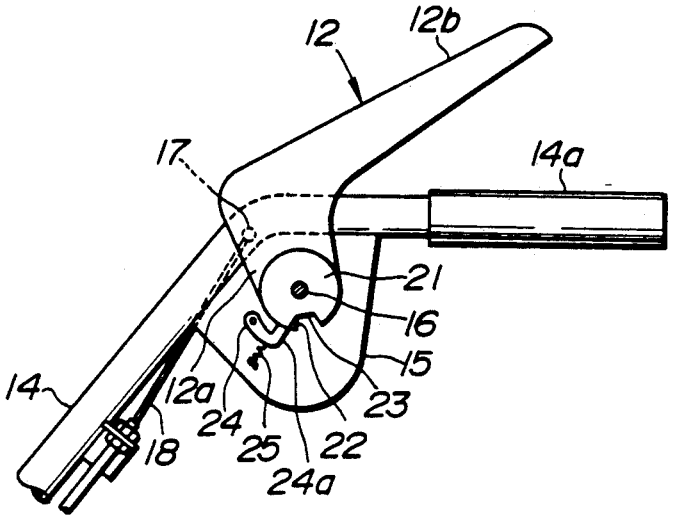
FIG. 4 is a fragmentary side elevational view of the rear portion shown in FIG. 3.

As shown in FIGS. 3 and 4, an interlink plate 21 is disposed inwardly of and adjacent to the attachment base 12*a* of the auger clutch lever 12, and the support shaft 16 extends through and is fixed to the interlink plate 21. Therefore, the interlink plate 21 turns in unison with the support shaft 16 in response to swinging movement of the wheel clutch lever 13. As shown in FIG. 4, the interlink plate 21 is of a circular shape, and the adjacent attachment base 12*a* of the auger clutch lever 12 has an arcuate lower portion which is concentric with the circular interlink plate 21. The lower outer circumference of the interlink plate 21 and the lower outer circumference of the attachment base 12*a* adjacent to the interlink plate 21 have recesses 22, 23, respectively, defined in the same angular or circumferential positions, as shown in FIGS. 4 through 6.

Figure 5:
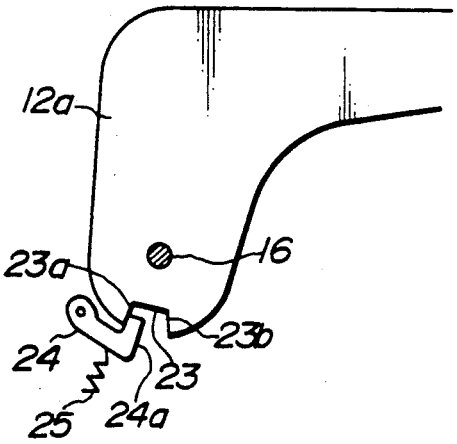
FIG. 5 is an enlarged side elevational view of an auger clutch lever and a lock finger as they engage each other.
Figure 6:
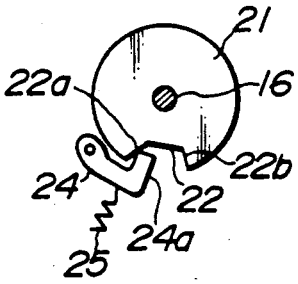
FIG. 6 is an enlarged side elevational view of an interlink plate and the lock finger as they engage each other.
Figure 8:
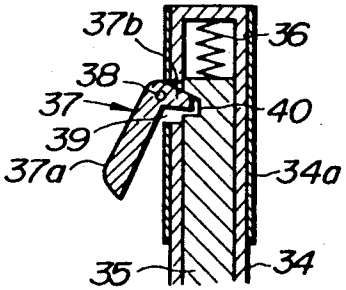
FIG. 8 is a fragmentary cross-sectional view of a grip portion of an auger height adjusting handle.

The recess 23 defined in the attachment base 12*a* has two opposite side walls 23*a*, 23*b* which extend linearly in the radial direction, as shown in FIG. 5. The recess 22 defined in the interlink plate 21 has a rear side wall 22*b* which extends linearly in the radial direction and a front side wall 22*a* which extends linearly and is inclined substantially horizontally, rather than in the radial direction, as shown in FIG. 6.

A lock finger 24 which is swingable in a vertical plane is mounted on an inner side of the bracket 15 on which the auger clutch lever 12 is supported. The lock finger 24 is normally urged by a spring 25 to cause a detent 24*a* on its distal end, which is directed toward the support shaft 16, to abut against those outer circumferential surfaces of the interlink plate 21 and the attachment base 12*a* which are positioned forwardly of the recesses 22, 23.

The interlinked wheel and auger clutch levers 13, 12 operate as follows:

When the wheel clutch lever 13 and the grip 14*a* are gripped together by the operator, the attachment base 13*a* is turned around and with the support shaft 16 thereby to pull the cable 20, thus engaging the corresponding clutch to rotate the drive axle 7, which then moves the snowplow 1 through the wheels 8, 10 and the crawlers 11. Upon the turning movement of the attachment base 13*a*, the interlink plate 21 also turns with the support shaft 16 until the recess 22 reaches an angular position facing the detent 24*a* of the lock finger 24. However, the detent 24*a* remains in abutment against the outer circumferential surface of the attachment base 12*a* which is positioned forwardly of the recess 23. Then, when the auger clutch lever 12 and the grip 14*a* are gripped together by the operator, the attachment base 12*a* turns around the support shaft 16, pulling the cable 18 which engages the corresponding clutch 5, so that the auger 5 is rotated. In response to the turning movement of the attachment base 12*a*, the recess 23 comes into alignment with the detent 24*a* of the lock finger 24. Since the detent 24*a* is biased toward the support shaft 16 by the spring 25, the detent 24*a* enters the recesses 22, 23. The lock finger 24 thus serves as a lock means for locking the auger clutch lever 12. Therefore, even when the auger clutch lever 12 is released from the gripping force while the wheel clutch lever 13 is being gripped, the auger clutch lever 12 is locked by the lock finger 24 whose detent 24*a* is inserted in the recess 23, and the corresponding clutch remains engaged. Simply by continuously gripping the wheel clutch lever 13 with one hand, the operator can maintain the transmission of engine power toward the drive axle 7 and the auger 5 even if the other hand releases the auger clutch lever 12.

In order to disengage the clutches, the wheel clutch lever 13 may be released from the gripping force. More specifically, when the wheel clutch lever 13 is released, the cable 20 is pulled forwardly under its tensile resiliency, causing the wheel clutch lever 13 to turn while disengaging the clutch coupled thereto. At this time, since the interlink plate 21 turns in unison with the support shaft 16 in response to the turning movement of the wheel clutch lever 13, the detent 24*a* of the lock finger 24 slides along the substantially horizontally inclined side wall 22*a* of the recess 22 in the interlink plate 21, while swinging forwardly. Finally, the detent 24*a* disengages from the recess 22. Therefore, the interlink plate 21 serves as means for unlocking the lock means (lock finger 24). When the detent 24*a* is displaced out of the recess 22, the detent 24*a* is also moved out of the recess 23, thus releasing the auger clutch lever 12. Under the tensile resiliency of the cable 18, the auger clutch lever 12 returns upwardly away from the grip 14*a*, and the clutch coupled thereto is also disengaged, thereby cutting off the transmission of engine power to the auger 5.

The auger 5 of the snowplow 1 can be adjusted in height depending on the qualities of the snow which is to be handled by the snowplow, the conditions of the surface on which the snowplow is used, etc. An auger height adjusting mechanism will now be described with reference to FIGS. 7 through 10.

Figure 7:
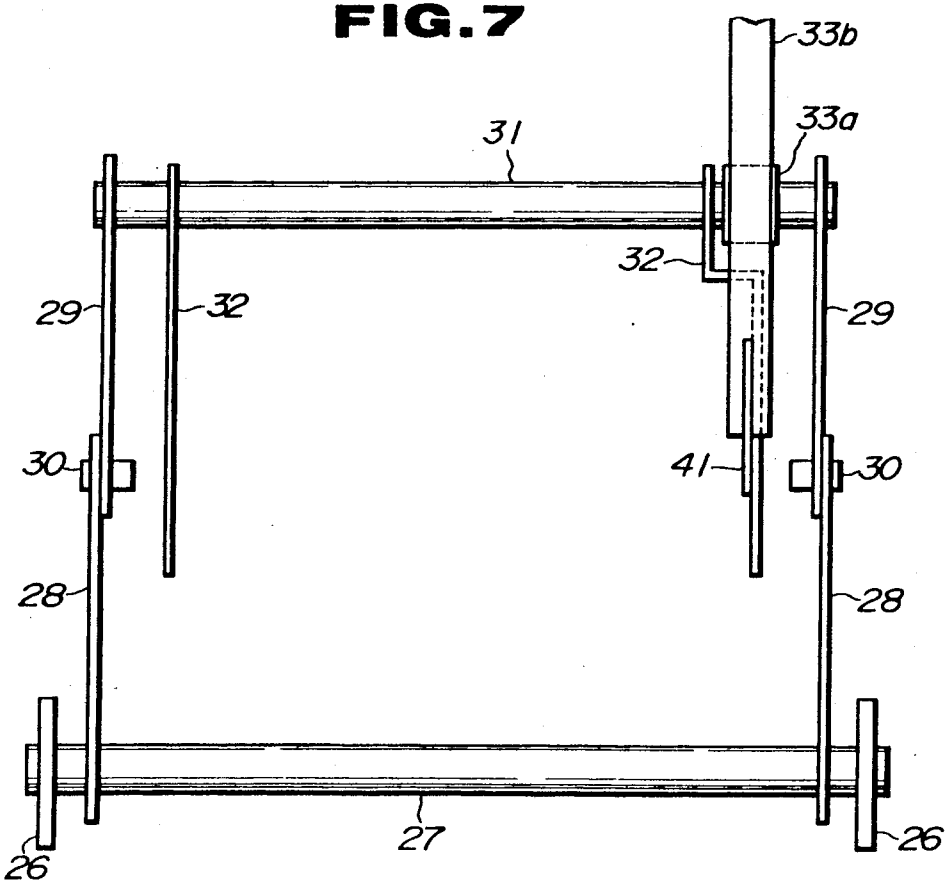
FIG. 7 is a rear elevational view of an auger height adjusting mechanism.

The front lower portion of the snowplow body 2 is angularly movably supported on the drive axle 7. When the rear portion of the snowplow body 2 is vertically swung about the drive axle 7, the auger housing 4 also swings therewith, thus varying the vertical position or height of the auger 5 within the auger housing 4. As shown in FIGS. 1 and 7, the drive axle 7 and the driven axle 9 are coupled to each other by two laterally spaced coupling frames 26 which are positioned between the snowplow body 2 and the crawlers 11. Lower links 28 have lower ends angularly movably mounted on the respective opposite ends of a fixed shaft 27 which is supported between rear portions of the coupling frames 26. The lower links 28 are connected at their upper ends to the lower ends of upper links 29, respectively, by joint pins 30 which allow relative angular movement of the links 28, 29. The upper links 29 have upper ends fixed to the opposite ends, respectively, of an angularly movable shaft 31 which extends transversely of the snowplow body 2. The angularly movable shaft 31 is supported between a pair of laterally spaced brackets 32 projecting rearwardly and upwardly from the rear end of the snowplow body 2. A auger height adjusting handle 33 extends substantially vertically behind a right-hand end of the angularly movable shaft 31, as viewed from behind the snowplow 1. The auger height adjusting handle 33 has a forwardly projecting branch 33*a* fixed to the angularly movable shaft 31.

The auger height adjusting handle 33 has a shank 33*b* which comprises, as shown in FIGS. 1 and 8 through 10, a vertical pipe 34 that is closed at an upper end and open at a lower end, and an engagement rod 35 inserted in the pipe 34. The engagement rod 35 is normally urged to move downwardly by a spring 36 disposed in the pipe 34 and held against the closed upper end thereof. The upper end portion of the pipe 34 is covered with a hollow grip 34*a* on which a control lever 37 is mounted by a support shaft 38 for back-and-forth swinging movement about the support shaft 38. The control lever 37 has a grip 37*a* extending from the support shaft 38 downwardly in front of the grip 34*a* of the pipe 34, and an engaging finger 37*b* extending rearwardly from the upper end of the grip 37*a*. The engaging finger 37*b* is inserted into the pipe 34 through a recess 39 defined in the grip 34*a* and the pipe 34. The engaging finger 37*b* engages in an engagement groove 40 defined in an outer circumferential surface of the upper end portion of the engagement rod 35, for thereby holding the engagement rod 35 in a vertical position. When the control lever 37 and the grip 34*a* of the pipe 34 are gripped together, and the grip 37*a* is pulled toward the grip 34*a* of the pipe 34, the engaging finger 37*b* turns upwardly, lifting the engagement rod 35 out of an engagement groove 42 in an engagement plate 41 (described below) against the bias of the spring 36.

Figure 9:
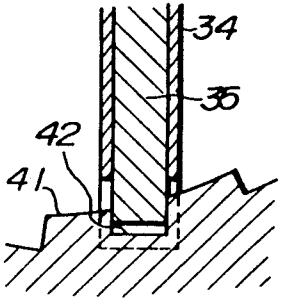
FIG. 9 is a fragmentary cross-sectional view of a lower end of the auger height adjusting handle and an engagement plate.
Figure 10:
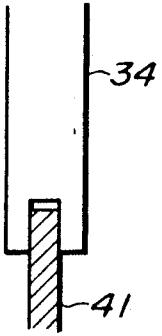
FIG. 10 is a sectional side elevational view of the assembly shown in FIG. 9.

As shown in FIGS. 1, 9 and 10, the engagement plate 41 is disposed below the auger height adjusting handle 33. The engagement plate 41 is in the form of an arcuate plate having a front end fixed to the righthand bracket 32 as viewed from behind the snowplow body 2 and a rear end extending rearwardly. The engagement plate 41 has a plurality of engagement grooves or notches 42 defined in an upper edge thereof lying below the auger height adjusting handle 33. The lower end of the pipe 34 is of a bifurcated shape having a central slot in which the upper edge of the engagement plate 41 is inserted at all times. The lower end of the engagement rod 35 which is normally urged downwardly by the spring 36 is inserted in one of the engagement grooves 42.

As shown in FIG. 2, a control panel 43 is disposed between the laterally spaced handle pipes 14 forwardly of the clutch levers 12, 13, the control panel 43 having a variety of guide holes defined therein. More specifically, the control panel 43 has a guide hole 44 for the auger height adjusting handle 33, defined in a righthand edge portion thereof as viewed from behind the snowplow 1, along one of the handle pipes 14. The auger height adjusting handle 33 extends through the guide hole 44, with the grip 34*a* projecting above the control panel 43. The other guide holes defined in the control panel 43 include a guide hole 45 which receives a control lever 49 for continuously varying the speed of travel of the snowplow 1, a guide hole 46 which receives a control lever 50 for turning the snowplow 1 to the left and right, a guide hole 47 which receives a control lever 51 for operating the auger 5 at a high or low speed, and a guide hole 48 which receives a control lever 52 for adjusting the direction of the shooter 6. The control panel 43 further has, on its rear end, a main switch 53, a choke button 54, and a light switch 55.

Height adjustment of the auger 5 will be described below.

In FIG. 1, the engagement rod 35 of the auger height adjusting handle 33 is inserted in the central engagement groove 42 of the engagement plate 41. The rear end of the snowplow 2 is held at a certain vertical position or height by the fixed shaft 27 through the links 28, 29 and the auger height adjusting handle 33, with the result the auger 5 is maintained at a certain height.

To lower the height of the auger 5 from the illustrated position, the grip 34*a* of the auger height adjusting handle 33 and the grip 37*a* of the control lever 37 are gripped together by the operator, and the grip 37*a* of the control lever 37 is moved rearwardly. The engaging finger 37*b* joined to the grip 37*a* is turned upwardly, thereby elevating the engagement rod 35 out of the central engagement groove 42 of the engagement plate 41. Now, the auger height adjusting handle 33 is rendered swingable back and forth. The handle 33 is pushed forwardly and then the grip 37*a* is released. The engagement rod 35 is lowered under the resiliency of the spring 36 until the lower end thereof is inserted into the rear engagement groove 42, whereupon the auger height adjusting handle 33 is held in angular position. Upon the forward angular movement of the auger height adjusting handle 33, the angularly movable shaft 31 fixed to the handle 33 is turned counterclockwise in FIG. 1. Consequently, lower ends of the upper links 29 whose upper ends are secured to the shaft 31 are turned rearwardly (counterclockwise in FIG. 1) about the shaft 31, which is also pushed upwardly due to the coaction of the links 29, 28. As a result, the rear portion of the snowplow body 2 swings upwardly (counterclockwise in FIG. 1) about the drive axle 7. Therefore, the auger 5 in front of the snowplow 2 is lowered, and hence the height thereof is reduced.

To increase the height of the auger 5 from the position shown in FIG. 1, the auger height adjusting handle 33 may be pulled rearwardly. More specifically, the grip 34*a* of the auger height adjusting handle 33 and the grip 37*a* of the control lever 37 are gripped together by the operator, and the grip 37*a* of the control lever 37 is pulled rearwardly until the engagement rod 35 is lifted out of the central engagement groove 42 of the engagement plate 41. The auger height adjusting handle 33 is pulled rearwardly and then the grip 37*a* is released. The engagement rod 35 is lowered under the resiliency of the spring 36 until the lower end thereof is inserted into the front engagement groove 42, whereupon the auger height adjusting handle 33 is held in angular position. Upon the rearward angular movement of the auger height adjusting handle 33, the angularly movable shaft 31 fixed to the handle 33 is turned clockwise in FIG. 1. Consequently, the lower ends of the upper links 29 are turned forwardly (clockwise in FIG. 1) about the shaft 31, which is also pushed downwardly due to the coaction of the links 29, 28. As a result, the rear portion of the snowplow body 2 swings downwardly (clockwise in FIG. 1) about the drive axle 7. Therefore, the auger 5 in front of the snowplow 2 is raised, and hence the height thereof is increased.

The upper and lower links 29 28 jointly constitute a link means which is extensible and contractable between the snowplow body 2 and the self-propelling mechanism, for varying the vertical distance between the fixed shaft 27 and the angularly movable shaft 31 in response to back-and-forth angular movement of the auger height adjusting handle 33. The link means therefore allows the auger 5 or the auger housing 4 in front of the snowplow body 2 to be easily adjusted in height.

Furthermore, as shown in FIG. 2, the auger height adjusting handle 33 extends up to a position above the control panel 43 which is positioned forwardly of the clutch levers 12, 13. Consequently, the leverage of the auger height adjusting handle 33 is large enough for the operator to manually lift, with a single hand, the snowplow body 2, the auger housing 4, the auger 5, and the shooter 6, which are relatively heavy, until a desired auger height is reached. While the snowplow 2 is running and clearing away snow, the operator can keep the snowplow 2 and the auger 5 in continuous operation simply by gripping the lefthand wheel clutch lever 13 with his left hand because the clutch levers 12, 13 are interlinked together by the lock finger 24. Accordingly, the operator can easily adjust the height of the auger 5 by operating the auger height adjusting handle 33, located near the righthand handle pipe 14, with the operator's free right hand.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

We claim:

1. A powered snowplow comprising:

a snowplow body which houses at least a power source;

a self-propelling mechanism supporting said snowplow body and drivable by said power source for propelling the snowplow;

an auger mechanism mounted on a front portion of said snowplow body, said auger mechanism having a snow collecting auger; and a control mechanism mounted on a rear portion of said snowplow body, said control mechanism including a first control lever operable for transmitting power from said power source to said self-propelling mechanism, a second control lever operable for transmitting power from said power source to said auger mechanism, an auger height adjusting handle disposed near said second control lever, for adjusting a height of said auger, and means for keeping said second control lever operated in coaction with said first control lever when the first control lever is operated.

2. A powered snowplow according to claim 1, wherein said self-propelling mechanism has a first pivot shaft, and said snowplow body and said auger mechanism are angularly movably mounted on said self-propelling mechanism by said first pivot shaft such that a height of said auger can be adjusted by angularly moving said rear portion of the snowplow body vertically bout said first pivot shaft with said auger height adjusting handle.

3. A powered snowplow according to claim 2, wherein said auger height adjusting handle is substantially vertically disposed on the rear portion of said snowplow body and has on a lower portion thereof a second pivot shaft which is angularly movably supported on the rear portion of said snowplow body;

said control mechanism further includes link means for vertically moving said second pivot shaft in response to back-and-forth swinging movement of said auger height adjusting handle, and thereby angularly moving said snowplow body about said first pivot shaft;

one end of said link means is coupled to said self-propelling mechanism, and said second pivot shaft is fixed to an opposite end of said link means.

4. A powered snowplow according to clam 3, wherein said link means comprises a first link having a lower end pivotally coupled to said self-propelling mechanism, and a second link having an upper end fixed to said second pivot shaft and a lower end pivotally coupled to an upper end of said first link; 'said link means being extensible and contractable to vertically move said second pivot shaft in response to the back-and-forth swinging movement of said auger height adjusting handle.

5. A powered snowplow according to claim 3, wherein said control mechanism further includes an engagement plate extending rearwardly from the rear portion of said snowplow body;

said auger height adjusting handle having a lower end engageably slidable on said engagement plate in response to the back-and-forth swinging movement of the auger height adjusting handle.

6. A powered snowplow according to claim 2, wherein said self-propelling mechanism comprises a pair of laterally spaced front drive wheels and a pair of laterally spaced rear driven wheels, said first pivot shaft comprising a drive axle which interconnects said front drive wheels.

7. A powered snowplow according to claim 1, wherein said control mechanism comprises a pair of handlebars extending rearwardly and upwardly from the rear portion of said snowplow body, and a control panel disposed between upper portions of said handlebars and having a guide hole extending along said handlebars and disposed near said second control lever, said fist control lever being pivotally coupled to one of said handlebars, and second control lever being pivotally coupled to the other handlebar, and said auger height adjusting handle extending through said guide hole so as to be guided thereby for back-and-forth swinging movement.

8. A powered snowplow according to claim 7, wherein each of said first and second control levers comprises an arm extending above an upper portion of a corresponding one of said handlebars and operable when gripped together with said upper portion of the handlebar, and an attachment base pivotally coupled to said upper portion of the handlebar and angularly movable in response to swinging movement of said arm; and said control mechanism further comprises lock means disposed on the upper portion of said other handlebar, for locking the attachment base of said second control lever in a predetermined angular position when said first and second control levers are simultaneously operated, and means for unlocking the attachment base of said second control lever when said first control lever is brought out of operation.

9. A powered snowplow comprising:

a snowplow body supporting a snow collecting auger on a front portion thereof;

a self-propelling mechanism for propelling the snowplow, said self-propelling mechanism including an axle and a pair of front wheels supported on said axle, said snowplow body being angularly movably supported on said axle; and auger height adjusting means for angularly moving said snowplow body with respect to said self-propelling mechanism to adjust a height of said snow collecting auger, said auger height adjusting means comprising a first pivot shaft extending transversely of a rear portion of said self-propelling mechanism, a second pivot shaft extending transversely of a rear portion of said snowplow body, a link mechanism operatively connected between said first and second pivot shafts, and an auger height adjusting handle substantially vertically disposed on the rear portion of said snowplow body for back-and-forth swinging movement, said auger height adjusting handle being coupled to said second pivot shaft and movable for turning said second pivot shaft to cause said link mechanism to vary the distance between said first and second pivot shafts.

10. A powered snowplow according to claim 9, further including an engagement plate extending rearwardly from the rear portion of said snowplow body;

said link mechanism comprising a pair of laterally spaced lower links having lower ends pivotally coupled to respective opposite ends of said first pivot shaft, and a pair of laterally spaced upper links having lower ends pivotally coupled to respective upper ends of said lower links and upper ends fixed to respective opposite ends of said second pivot shaft; and said auger height adjusting handle having on a lower portion thereof a branch fixed to said second pivot shaft and a lower end engageably slidable on and along said engagement plate in response to the back-and-forth movement of the auger height adjusting handle.

11. A powered snowplow according to claim 10, further including a pair of parallel handlebars extending rearwardly and upwardly from the rear portion of said snowplow body, and a control panel disposed between upper portions of said handlebars, said control panel having a guide hole extending along said handlebars; and said auger height adjusting handle having a grip extending upwardly through said guide hole.

12. A powered snowplow according to claim 11, further including a wheel clutch lever mounted on the upper portion of one of said handlebars and operable to engage a clutch which transmits power to said self-propelling mechanism, an auger clutch lever mounted on the upper portion of the other handlebar and operable to engage a clutch which transmits power to said snow collecting auger, and means for keeping said auger clutch lever operated in coaction with said wheel clutch lever when the wheel clutch lever is operated;

said grip of said auger height adjusting lever being disposed near said auger clutch lever.

* * * * *

UNITED STATES PATENT AND TRADEMARK OFFICE

CERTIFICATE OF CORRECTION

PATENT NO. : 5,020,250

DATED : June 4, 1991

INVENTOR(S) : Fujii et al.

It is certified that error appears in the above identified patent and that said Letters Patent is hereby corrected as shown below:

Abstract, line 1, after "body" delete --housing--.
Col. 1, line 29, after "pedal" insert -- . --.
Col. 7, line 39, after "29" insert --, --.
Col. 8, line 36, change "bout" to -- about --;
line 53, change "clam" to -- claim --.

Signed and Sealed this

Twenty-second Day of September, 1992

*Attest:*

DOUGLAS B. COMER

*Attesting Officer*

*Acting Commissioner of Patents and Trademarks*